United States Patent [19]

Qader

[11] 4,331,530

[45] May 25, 1982

[54] PROCESS FOR THE CONVERSION OF COAL

[75] Inventor: Shaik A. Qader, Claremont, Calif.

[73] Assignee: Occidental Research Corporation, La Verne, Calif.

[21] Appl. No.: 881,233

[22] Filed: Feb. 27, 1978

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 2,756,194 | 7/1956 | Mayland | 208/10 |
| 3,030,297 | 4/1962 | Schroeder | 208/8 |
| 3,039,955 | 6/1962 | Honnold | 208/132 |
| 3,152,063 | 10/1964 | Schroeder et al. | 208/10 |
| 3,231,486 | 1/1966 | Perry et al. | 208/8 |
| 3,231,486 | 1/1966 | Perry et al. | 208/10 X |
| 3,488,279 | 1/1970 | Schulman | 208/10 |
| 3,505,204 | 4/1970 | Hoffman | 208/10 |
| 3,549,512 | 12/1970 | Hodgson | 208/10 |
| 3,565,766 | 2/1971 | Eddinger et al. | 201/23 |
| 3,635,814 | 1/1972 | Rieve et al. | 208/10 |
| 3,729,407 | 4/1973 | Camp et al. | 208/10 |
| 3,764,515 | 10/1973 | Kiovsky | 208/10 |
| 3,844,928 | 10/1974 | Geymer | 208/10 |
| 3,855,070 | 12/1974 | Squires | 201/23 |
| 3,926,775 | 12/1975 | Schroeder | 208/10 |
| 3,944,480 | 3/1976 | Schroeder | 208/10 |
| 3,960,701 | 6/1976 | Schroeder | 208/8 |
| 3,988,236 | 10/1976 | Albright et al. | 208/8 |
| 4,019,975 | 4/1977 | Urquhart | 208/10 |
| 4,077,867 | 3/1978 | Aldridge et al. | 208/10 |
| 4,078,989 | 3/1978 | Leas | 208/10 |
| 4,081,400 | 3/1978 | Gorin | 208/10 X |

FOREIGN PATENT DOCUMENTS

| | | | |
|---|---|---|---|
| 1625 | of 1926 | Australia | 208/10 |
| 535746 | 1/1957 | Canada | 208/10 |
| 438084 | 11/1935 | United Kingdom | 208/10 |

*Primary Examiner*—Delbert E. Gantz
*Assistant Examiner*—William G. Wright
*Attorney, Agent, or Firm*—Christie, Parker & Hale

[57] ABSTRACT

A process for the hydrogenation of coal and subsequent treatment of hydrogenated coal to produce useful fuels and chemicals which comprises comminuting coal ore to a particle size range of from about 150 mesh to about 250 mesh; hydrogenating the particulate coal in the presence of a hydrogenation catalyst and a source of hydrogen at a temperature of from about 100° to about 300° C. and a pressure of from about 500 to about 1,000 psi for a time sufficient to react hydrogen with the coal to form predominantly hydroaromatic coal; and recovering the hydrogenated coal. The hydrogenated coal is subsequently hydrocracked or pyrolyzed. The hydrogenated coal is hydrocracked at from about 500° to about 700° C. a pressure of from about 500 to about 2,000 psi for a time sufficient to crack the coal to produce benzene, toluene, xylene and gasoline. The hydrogenated coal is pyrolyzed at from about 400° to about 700° C., at a pressure of about atmospheric pressure and for a time sufficient to convert the coal to $C_1$–$C_4$ gaseous hydrocarbons, naphtha and tar.

14 Claims, No Drawings

PROCESS FOR THE CONVERSION OF COAL

BACKGROUND OF THE INVENTION

Increasing energy needs have focused attention on solid fossil fuels due to their availability in the United States in a relatively abundant supply and their potential value when converted into more useful forms of energy and feedstock. Coal is known to be a potential valuable source of chemical compounds as well, and considerable effort has been expended in attempts to develop a process for the efficient production of such chemicals and such fuel products.

It has been proposed to hydrogenate coal with hydrogen gas in the presence of a solvent and a catalyst at moderate to severe conditions of temperature and pressure. The product is determined by the reaction conditions, catalyst, and space velocity or residence time. It has been widely accepted that coal does not begin to decompose until it has reached the temperature of about 350° to about 400° C. At the temperatures generally employed for such hydrogenation, hitherto generally above 400° C., the coal substance breaks down, the molecular chains in the coal being cleaved to from lower molecular weight substances. These products often have a molecular size such that they are suitable for use as fuel oils or the like, and they can be subjected to hydrocracking for conversion into "synthetic gasoline."

In the state-of-the-art hydrogenation processes, a recyclable "pasting oil" was necessary to initially dissolve or slurry the raw coal. The slurry of coal, usually containing a catalyst, was generally heated in the presence of hydrogen gas at about 450° C. to 550° C. and about 2,000 to 10,000 psig. Following hydrogenation finely-divided unreacted coal ash had to be filtered or otherwise removed from the heavy, viscous primary oil product. These processes, generally were not commercially acceptable because of the large capital investment, the high operating costs and the hydrogen requirements were too high in comparison with the value of the products obtained.

More recently, dry hydrogenation processes have been developed wherein coal is heated with hydrogen gas. However, these processes are generally batch-type processes and because they are conducted at greatly elevated temperatures and pressures, result in the production of hydrocarbon gases and liquids useful mainly as fuel. Greatly elevated temperatures and pressures at which these processes functioned make them difficult to operate and impractical.

SUMMARY OF THE INVENTION

In accordance with the present invention, there is provided a process for the conversion of predominantly aromatic coals to predominantly hydroaromatic and highly reactive coals by low temperature and low pressure hydrogenation using a gaseous or solid catalyst. Non-metallurgical coals also get converted to metallurgical coals. The hydrogenation reaction occurs in the temperature range of about 100° to about 300° C. and at a pressure of from about 500 to about 1,000 psi in dry phase. Residence time can be from about 10 seconds to about 10 minutes. Coals of all ranks can be hydrogenated without any agglomeration problems since the reaction takes place well below the plastic range. Reaction can be carried out in fixed, entrained, moving and fluidized bed systems. The yield of hydrogenated coal is from about 101 to 103 percent of the raw coal on maf basis. Hydrogen consumption varies from about 1 to about 3 percent and catalyst consumption negligible. The aromatic structures present in the coal are hydrogenated to hydroaromatic structures without cracking of the structures. The process produces reactive, solid hydroaromatic coal which can be easily converted to liquid fuels and chemicals by cracking and pyrolytic processes. The process also produces metallurgical coals from nonmetallurgical coals.

Further, there is provided a second step in the process for the conversion of coal wherein the hydroaromatic product of the select low temperature and low pressure hydrogenation can be hydrocracked at from about 500° to about 700° C. under a pressure of about 500 to about 2,000 psi. Residence time can range from about 1 to about 60 seconds and no catalyst is required. Conversion of the coal varies between about 60 to about 90 percent. The hydrocracking products are benzene, toluene, xylene and gasoline.

Alternatively, the hydroaromatic product of the select low temperature and low pressure hydrogenation is pyrolyzed at from about 400° to about 700° C. at atmospheric pressure. Residence time varies from about 1 to about 60 seconds. Conversion of the coal ranges from about 60 to about 80 percent and liquid yield is about 50 to about 60 percent. The coal is mainly converted to $C_1$–$C_4$ hydrocarbons, naphtha and tar.

DETAILED DESCRIPTION OF THE INVENTION

As used herein, the term hydroaromatic coal refers to partially saturated aromatic coal which has a hydrogen content of from about 1.1 to about 1.6 atoms of hydrogen per carbon atom.

According to the present invention there is provided a process for the conversion of coal to liquid fuels and useful chemicals by the hydrogenation of the coal and subsequent hydrocracking or pyrolysis of the hydrogenated coal produced thereby. These reactions of coal also produce a carbon-containing, solid product which, for convenience, may be termed char or coke. Coals are materials formed by degradation of cellulose material of plant origin. The degradation has been carried out under varying conditions of heat and pressure. Coals are believed in general to comprise cross-linked carbon structures of varying degrees of aromaticity, and which structures include various elements other than carbon and hydrogen; in particular, oxygen, nitrogen and sulphur. In the formation of coal, in general, oxygen and hydrogen are lost from the coal as the degree of cross-linking increases. The properties of coal, therefore, vary in accordance with their age and history. The term coal is used herein to include anthracite coal, bituminous coal, sub-bituminous coal, lignite, peat and the like.

Advantageously, the coal is employed as a finely divided form. The coal may naturally exist in the desired particle size, or, if not, it may be comminuted and classified to desired particle size ranges by methods known in the art. It is preferred to use coal of a particle size of from about 150 to about 250 mesh. Smaller particle size can be used but offer no substantial advantage and larger particle size can be used but efficiency of hydrogenation will decrease due to some carbon within the coal particles being left unreacted. More preferably, the coal particles are from about 180 to about 220 mesh.

The comminuted coal is passed through a hydrogenation zone where it is contacted with hydrogen rich gas in the presence of a catalyst. The catalysts that can be employed in the hydrogenation process of this invention can be utilized in either a solid phase or gaseous phase. Solid catalysts that can be used in the practice of the method of this invention include nickel, palladium, oxides and sulfides of cobalt, molybdenum, nickel, tungsten and other transition metals selected from Groups VI, VII and VIII of the Periodic Table, as well as their mixtures, alone or preferably supported on finely divided porous and nonporous inert supports such as silica, alumina and mixtures thereof. Gaseous, or vapor phase catalysts useful in the hydrogenation step of the process of this invention can be selected from halides of zinc and tin; and carbonyls of cobalt, iron and other transition metals selected from Groups VI, VII and VIII of the Periodic Table. The Periodic Table referred to is the Periodic Table as shown on page B-4 of the *Handbook of Chemistry and Physics*, 57th Ed., CRC Press, incorporated herein by reference.

The hydrogen rich gas can be supplied externally or can be a combination of externally supplied hydrogen and hydrogen generated or recycled from the hydrogenation process or one of the subsequent steps of pyrolysis or hydrocracking. The hydrogen rich gas that is employed for the hydrogenation need not be pure and can, for example, be formed by the reaction of steam with carbon. In particular, there may also be present in the vapor phase, carbon monoxide which may react with water under reaction conditions to produce hydrogen. Hydrogen consumption in the hydrogenation is low, generally from about 1 to about 3 percent of moisture and ash free (maf) coal.

The hydrogenation process is conducted at relatively low temperatures for hydrogenation. Previously, hydrogenation was conducted generally at temperatures greater than 300° C. In accordance with the process of this invention the hydrogenation is conducted at a temperature of from about 100° to about 300° C. and a pressure range of from about 500 to about 1,000 psi. Temperatures below about 100° C. generally do not promote hydrogenation to any substantial degree so as to be economically attractive. Temperatures greater than about 300° C. promote hydrogenation to a substantial degree and promote cracking of the coal molecules such that the products formed do not have the desired aromatic or hydroaromatic nature. The preferred temperature range at which the hydrogenation of the process of this invention is conducted is substantially below the plastic range for the coal, the temperature at which the coal begins to flow and deform under applied heat. Conducting hydrogenation at this low temperature advantageously reduces the possibility of agglomeration problems such that substantially no agglomeration of the coal particles occurs. More severe conditions of temperature and pressure present agglomeration problems whereby the separation of catalyst from the coal is difficult and expensive. Additionally, more severe conditions of temperature and pressure cause excessive cracking of the hydrocarbon molecules which increases the gaseous products yield and increases hydrogen consumption. By conducting the hydrogenation in the preferred range of about 100° to about 300° C. the coal is converted to predominantly hydroaromatic and highly reactive coal substantially without formation of liquid or gaseous products. The hydrogenated coal particles can be converted to liquid fuels and desirable chemicals by subsequent cracking and pyrolytic steps in high yields of about 50 to about 70%. Residence times for the coal within the hydrogenation zone for the hydrogenation will vary dependent upon the temperature and catalyst. It is preferred, however, to have a residence time of from about 10 seconds to about 10 minutes at the preferred temperature range.

The method of this invention is versatile due to the mild reaction conditions of low temperature and low pressure. Due to the mild conditions, hydrogenation of the coal can be carried out in fixed, entrained, moving and fluidized bed systems, as is readily apparent to those skilled in the art.

The hydrogen rich gas and catalyst are recovered from the hydrogenation zone and recycled and combined with a new particulate coal ore feed. Makeup hydrogen to replace the hydrogen consumed can be produced by the gasification of char or from any other convenient source. The gasification of char for the production of hydrogen is particularly well suited for the process of this invention as char can be produced as a by-product during the subsequent treatment of the hydrogenated coal by either pyrolysis or hydrocracking. When the catalyst employed is in the vapor phase the catalyst is separated from the hydrogenated coal by normal methods of phase separation. If the catalyst is a solid catalyst, the effluent from the hydrogenation zone is passed into a classifier whereupon the catalyst is separated from the hydrogenated coal and is recycled to the hydrogenation zone.

The hydrogenated coal produced by the above described process is substantially a solid particulate product of a hydroaromatic nature. Under the select conditions of the process there is substantially no liquid or gaseous products. The hydrogenated coal is highly reactive and can be further processed either by hydrocracking or pyrolysis to produce liquid fuels and other chemicals. The predominantly hydroaromatic and highly reactive coal produced by the process of hydrogenation of this invention is easily and inexpensively cracked or pyrolyzed to provide relatively high yields of from about 50 to about 70 percent products.

Following hydrogenation of the coal and separation of the hydrogenated coal from the catalyst, the hydrogenated coal can be passed into a hydrocracking zone. Preferably, the hydrogenated coal is cracked at from about 500° to about 700° C., a pressure of from about 500 to about 2,000 psi and at a residence time of from about 1 to about 60 seconds. Under the preferred hydrocracking conditions there is produced essentially benzene, toluene, xylene and gasoline as liquid products and $C_1$–$C_4$ gaseous hydrocarbons. Due to the highly reactive condition of the hydrogenated particulate coal feed into the hydrocracking zone there is good conversion of the coal to the liquid products. Generally, conversion is within the range of from about 60 to about 90 percent of the coal on an maf basis.

Alternatively, the hydrogenated coal, following separation from the hydrogenation catalyst, can be passed into a pyrolysis zone. Preferably, the hydrogenated coal is pyrolyzed at from about 400° to about 700° C., at about atmospheric pressure and at a residence time of from about 1 to about 60 seconds. Under the preferred conditions for pyrolysis the coal is substantially converted to $C_1$–$C_4$ gaseous hydrocarbons, naphtha and tar. Generally, due to the highly reactive nature of the hydrogenated coal, the coal conversion by pyrolysis is from about 60 to about 90 percent efficient on maf basis.

The tar produced can be hydrorefined to obtain clean fuels.

Both the hydrocracking and pyrolysis steps produce a residue or char consisting substantially of carbon. The char can be treated with steam and oxygen to produce oxides of carbon and hydrogen gas. The hydrogen produced from the char can be passed into the initial hydrogenation zone as a source for hydrogen and to replace hydrogen that had been depleted by the hydrogenation reaction.

The invention is further illustrated by the following examples, which are not intended to be limiting.

EXAMPLE 1

A quantity of bituminous coal is comminuted to 200 mesh. The coal has an aromatic carbon content of 65%, a hydroaromatic carbon content of 25%, and a swelling index of 3.5.

The comminuted coal is passed through a hydrogenation zone of 150° C. at a pressure of 1,000 psi. The coal is maintained in the hydrogenation zone for a period of five minutes. Concomitant with the coal in the hydrogenation zone is a solid catalyst on a support.

The hydrogenated coal produced has an aromatic carbon content of 25%, a hydroaromatic carbon content of 65% and a swelling index greater than 5.

EXAMPLE 2

A quantity of bituminous coal is comminuted to 200 mesh. The coal has an aromatic carbon content of 65%, a hydroaromatic carbon content of 25% and a swelling index of 3.5.

The comminuted coal is passed through a hydrogenation zone of 150° C. at a pressure of 1,000 psi. The coal is maintained in the hydrogenation zone for a period of 5 minutes. Concomitant with the coal in the hydrogenation zone is a catalyst in a vapor phase.

The hydrogenated coal produced has an aromatic carbon content of 25%, a hydroaromatic carbon content of 65% and a swelling index greater than 5.

EXAMPLE 3

A quantity of bituminous coal is comminuted to 200 mesh. The coal has an aromatic carbon content of 65% and a hydroaromatic carbon content of 25%.

The comminuted coal is passed through a hydrogenation zone of 150° C. at a pressure of 1,000 psi. The coal is maintained within the hydrogenation zone for five minutes. The hydrogenated coal produced is 102%. Hydrogen consumption is 2% and catalyst consumption is negligible.

The hydrogenated coal is passed through a hydrocracking zone at a temperature of 600° C. and pressure of 1000 psi for 20 seconds. There is a 75% conversion of the hydrogenated coal. The product composition is benzene, toluene and xylene 35%; gasoline 15%; heavy oil 5%; and gas 20%. Hydrogen consumption is 2%.

EXAMPLE 4

The procedure of example 3 is repeated in all essential details with the exception that the hydrocracking is conducted at 700° C., a pressure of 1,500 psi for a period of 15 seconds.

There is an 87% conversion of the hydrogenated coal. Hydrogen consumption is 3%. The product composition is benzene, toluene and xylene 40%; gasoline 20% and heavy oil 25%.

EXAMPLE 5

A quantity of bituminous coal is comminuted to 200 mesh. The comminuted coal has an aromatic carbon content of 65% and a hydroaromatic carbon content of 25%.

The comminuted coal is passed through a hydrogenation zone at 150° C. and a pressure of 1,000 psi for a total residence within the zone of 5 minutes. The hydrogenated consumption is 2%. Catalyst consumption is negligible.

The hydrogenated coal is passed into a pyrolysis zone at a temperature of 600° C. at near atmospheric pressure for 5 seconds.

The products of the pyrolysis are $C_1$–$C_4$ gaseous hydrocarbons and naphtha with a 70% conversion.

EXAMPLE 6

A quantity of bituminous coal is comminuted to 200 mesh. The comminuted coal has an aromatic carbon content of 65% and a hydroaromatic carbon content of 25%.

The comminuted coal is passed through a hydrogenation zone at 150° C., a pressure of 2,000 psi for a total residence time within the zone of 5 minutes. The hydrogenated coal product yield is 102%. Hydrogen consumption is 3% and catalyst consumption is negligible.

The hydrogenated coal is passed through a pyrolysis zone at 600° C. at near atmospheric pressure for 5 seconds.

The products of the pyrolysis are $C_1$–$C_4$ gaseous hydrocarbons and naphtha in 80% yield.

What is claimed is:

1. A process for the hydrogenation of coal which comprises:

(a) comminuting coal ore to a particle size range of from about 150 mesh to about 250 mesh;

(b) hydrogenating the particulate coal in a hydrogenation zone in the presence of a hydrogenation catalyst in the vapor phase and selected from the group consisting of halides of zinc and tin, carbonyls of cobalt, iron, transition metals selected from Groups VI, VII and VIII of the Periodic Table, and mixtures thereof, and hydrogen at a temperature of from about 100° to about 300° C. and a pressure of from about 500 to about 1,000 psi for a time sufficient to react hydrogen with the coal to form predominantly hydroaromatic coal; and (c) recovering the hydrogenated, hydroaromatic coal from the hydrogenation zone.

2. The process of claim 1 wherein the particulate coal is within the hydrogenation zone for a residence time of from about 10 seconds to about 10 minutes.

3. The process of claim 1 wherein the catalyst is recovered from the hydrogenated coal and is recycled to the hydrogenation zone.

4. The process of claim 1 wherein the hydrogen for the hydrogenation is generated by the gasification of char.

5. A process for the conversion of coal which comprises:

(a) comminuting coal ore to a particle size of from about 150 mesh to about 250 mesh;

(b) hydrogenating the particulate coal in a hydrogenation zone in the presence of a hydrogenation catalyst in vapor phase and selected from the group consisting of halides of zinc and tin, and carbonyls of cobalt, iron and other transition metals selected from Groups VI, VII and VIII of the Periodic Table, and mixtures thereof, and hydrogen at a temperature of from about 100° to about 300° C. and a pressure of from about 500 to about 1000 psi for a time sufficient to react hydrogen with the coal to form predominantly hydroaromatic coal;

(c) recovering the hydrogenated, hydroaromatic coal from the hydrogenation catalyst; and (d) hydrocracking the hydrogenated coal in a hydrocracking zone at a temperature of from about 500° to about 700° C. and a pressure from about 500 to about 2000 psi.

6. The process of claim 5 wherein the particulate coal is within the hydrogenation zone for a residence time of from about 10 seconds to about 10 minutes.

7. The process of claim 5 wherein the hydrogenated coal is within the hydrocracking zone for a residence time of from about 1 to about 60 seconds.

8. The process of claim 5 wherein the catalyst is recovered from the hydrogenated coal and is recycled to the hydrogenation zone.

9. The process of claim 5 wherein the hydrogen for the hydrogenation step is generated by the gasification of the char produced during the hydrocracking.

10. A process for the conversion of coal which comprises:

(a) comminuting coal ore to a particle size of from about 150 mesh to about 250 mesh;

(b) hydrogenating the particulate coal in a hydrogenation zone in the presence of a hydrogenation catalyst in vapor phase and selected from the group consisting of halides of zinc and tin, and carbonyls of cobalt, iron and other transition metals selected from Groups VI, VII and VIII of the Periodic Table, and mixtures thereof, and hydrogen at a temperature of from about 100° to about 300° C. and a pressure of from about 500 to about 1000 psi for a time sufficient to react hydrogen with the coal to form predominantly hydroaromatic coal;

(c) recovering the hydrogenated, hydroaromatic coal from the hydrogenation catalyst; and (d) pyrolyzing the hydrogenated coal in a pyrolysis zone at a temperature of from about 400° to about 700° C. at about atmospheric pressure for a time sufficient to produce $C_1$–$C_4$ gaseous hydrocarbons, naphtha and char.

11. The process of claim 10 wherein the particulate coal is within the hydrogenation zone for a residence time of from about 10 seconds to about 10 minutes.

12. The process of claim 10 wherein the hydrogenated coal is within the pyrolysis zone for a residence time of from about 1 to about 60 seconds.

13. The process of claim 10 wherein the catalyst is recovered from the hydrogenated coal and is recycled to the hydrogenation zone.

14. The process of claim 10 wherein the hydrogen for the hydrogenation is generated by the gasification of the char produced during the pyrolysis.

* * * * *